US007180026B1

(12) United States Patent
Guntveit et al.

(10) Patent No.: US 7,180,026 B1
(45) Date of Patent: Feb. 20, 2007

(54) DEVICE FOR A REVERSE VENDING MACHINE FOR BOTTLES AND CANS

(75) Inventors: Lars Guntveit, Vollen (NO); Niels Erik Andersen, Vollen (NO)

(73) Assignee: Repant AS (NO)

( * ) Notice: Subject to any disclaimer, the term of this patent is extended or adjusted under 35 U.S.C. 154(b) by 0 days.

(21) Appl. No.: 10/019,770

(22) PCT Filed: Apr. 11, 2000

(86) PCT No.: PCT/NO00/00116

§ 371 (c)(1),
(2), (4) Date: May 1, 2002

(87) PCT Pub. No.: WO00/67211

PCT Pub. Date: Nov. 9, 2000

(30) Foreign Application Priority Data

Apr. 19, 1999 (NO) ..... 19991853

(51) Int. Cl.
*B07C 5/00* (2006.01)
*G07F 7/00* (2006.01)

(52) U.S. Cl. ..... 209/583; 194/209; 100/91

(58) Field of Classification Search ..... 312/265.6, 312/265.5, 229, 42, 45, 72; 100/129 X, 902, 100/91, 99, 156; 209/583, 524, 930; 194/209, 194/208, 213; *G07F 7/06*
See application file for complete search history.

(56) References Cited

U.S. PATENT DOCUMENTS 649,851 A * 5/1900 Levine ..... 312/228
2,520,380 A * 8/1950 Wegman ..... 222/108
2,569,828 A * 10/1951 Peacock et al. ..... 312/100
2,592,394 A * 4/1952 Cochran ..... 62/276

(Continued)

FOREIGN PATENT DOCUMENTS

DE 4318388 A1 * 12/1994

(Continued)

OTHER PUBLICATIONS

Tomra presents its latest breakthrough in reverse vending machine technology, Tomra News, News from the Tomra Network Jan. 1997.

(Continued)

*Primary Examiner*—Richard E. Chilcot, Jr.
*Assistant Examiner*—Tan Le
(74) *Attorney, Agent, or Firm*—Andrus, Sceales, Starke & Sawall, LLP

(57) ABSTRACT

In a reverse vending machine the feed opening (22) in the front cover (14), for bottles and cans, is without a fixed connection to pipework, etc. At the same time, an opening (26) for emptying remnants is formed in the front cover (14), in the form of a bowl, which merges at the back side of the front cover into a drain pipe socket (28) positioned above an upwards open drain channel (30) in the interior of the machine, without a fixed connection between the drain pipe socket (28) and the channel (30). The front cover is possibly lockable and can be opened to the side by means of hinges (24), whereby the interior of the reverse vending machine is uncovered for inspection, maintenance or repair.

3 Claims, 2 Drawing Sheets

U.S. PATENT DOCUMENTS

| | | | | | |
|---|---|---|---|---|---|
| 3,856,676 | A | * | 12/1974 | Grimme et al. | 210/96.1 |
| 4,919,274 | A | * | 4/1990 | Hammond | 209/583 |
| 4,953,682 | A | * | 9/1990 | Helbawi | 194/208 |
| 4,989,507 | A | * | 2/1991 | Rhoades et al. | 100/91 |
| 5,161,661 | A | * | 11/1992 | Hammond | 194/209 |
| 5,239,920 | A | * | 8/1993 | Schuff et al. | 100/45 |
| 5,361,913 | A | * | 11/1994 | Melchionna | 209/583 |
| 5,469,783 | A | * | 11/1995 | Fry | 100/49 |
| 5,671,666 | A | * | 9/1997 | Wenglar | 100/91 |
| 5,704,558 | A | * | 1/1998 | Arrott | 241/47 |
| 6,186,308 | B1 | * | 2/2001 | Coyne et al. | 194/209 |
| 6,581,627 | B2 | * | 6/2003 | Dillon | 137/360 |

FOREIGN PATENT DOCUMENTS

| | | |
|---|---|---|
| DE | 297 06 654 | 10/1997 |
| DE | 93 21 439 | 6/1998 |
| GB | 2 263 418 | 7/1993 |

OTHER PUBLICATIONS

Tomra Launches its exciting new web-site!, Tomra News, News from the Tomra Network Jan. 1998.

* cited by examiner

DEVICE FOR A REVERSE VENDING MACHINE FOR BOTTLES AND CANS

CROSS REFERENCE TO RELATED APPLICATION

The present application is the U.S. national stage application of International Application PCT/NO00/00116, filed Apr. 11, 2000, which international application was published on Nov. 9, 2000 as International Publication WO 00/67211 in the English language. The International Application claims priority of Norwegian Patent Application 19991853, filed Apr. 19, 1999.

SUMMARY OF THE INVENTION

This invention relates to reverse vending machines, and more particularly it concerns a device for a reverse vending machine for bottles and/or cans, wherein the machine construction has a front cover, which is formed with a hole therethrough for the bottles and cans, and which covers the mechanisms behind; the mechanism handles bottles and cans fed through the feed opening; counts the number and types thereof and calculates and supplies the customer, in return, with a note stating the sum due to him/her.

The bottles and cans accepted by ordinary reverse vending machines have essentially served as containers for drinks, and it is quite common for them to contain some remaining drops, which desirably should not be brought with the bottle or can into the structure of the reverse vending machine.

Therefore, a sink is often provided near reverse vending machines of this kind, into which sink bottles and cans containing any remnants of drinks, can be emptied before the bottles and cans are put into the reverse vending machine.

However, it is expensive to install a particular sink at each reverse vending machine. The sink will seldom blend in with the immediate surroundings in the shop, and, although the sink is placed near the reverse vending machine, even a relatively short distance will involve emptying bottles and cans and will be considered a separate operation considerably slowing down the bottle depositing process.

Another drawback of reverse vending machines of the kind in question is that the dismantling of the machine construction is relatively complicated, as individual parts have been assembled and secured to one another, so that dismantling will often have to be started from the back side, i.e. opposite the machine's feed opening for bottles and cans.

BRIEF DESCRIPTION OF THE INVENTION

The purpose of the present invention has therefore been to alleviate or reduce, to a substantial degree, these drawbacks and defects by simple and cheap means.

According to the invention the objectives have been realized in that the reverse vending machine is formed and arranged in accordance with the subject matter of the claims.

According to the present invention, near the bottle/can feed opening the front cover of the reverse vending machine is formed with a particular drain opening for remnants, which does not communicate with the fixtures within the reverse vending machine through joined pipes and pipe bends, with the drain opening possibly being provided with a bowl with a freely ending drain pipe socket at the back, which pipe socket may have its end opening above a fixed drain channel located within the reverse vending machine and having an outlet of its own, but being without connection to the front cover.

The drain channel may conveniently be placed under the bottle feed opening as well as the drain opening for remnants, so that also any remnants of drinks from the bottles and cans put through the feed opening, could land in the drain channel and from there into the outlet. Thus, the drain channel with outlet works like a draining device for the entire reverse vending machine construction.

Thus, according to the invention, a more reasonable and convenient positioning of the place for pouring out remnants is achieved, while at the same time the front cover of the machine can be hinged for full uncovering of the internal mechanisms of the reverse vending machine, for example for repair or maintenance purposes. Such a constructional solution, in which the front cover has no connection at all to fixtures in the form of pipe systems etc. is advantageous for repairs on the machine construction. The hinges of the front cover may be dual hinges and the front cover may be provided with a lock device.

BRIEF DESCRIPTION OF THE DRAWING

A non-limiting example of a preferred embodiment will be explained in the following with reference to the accompanying drawings, in which.

DETAILED DESCRIPTION OF THE INVENTION

Figure 1:
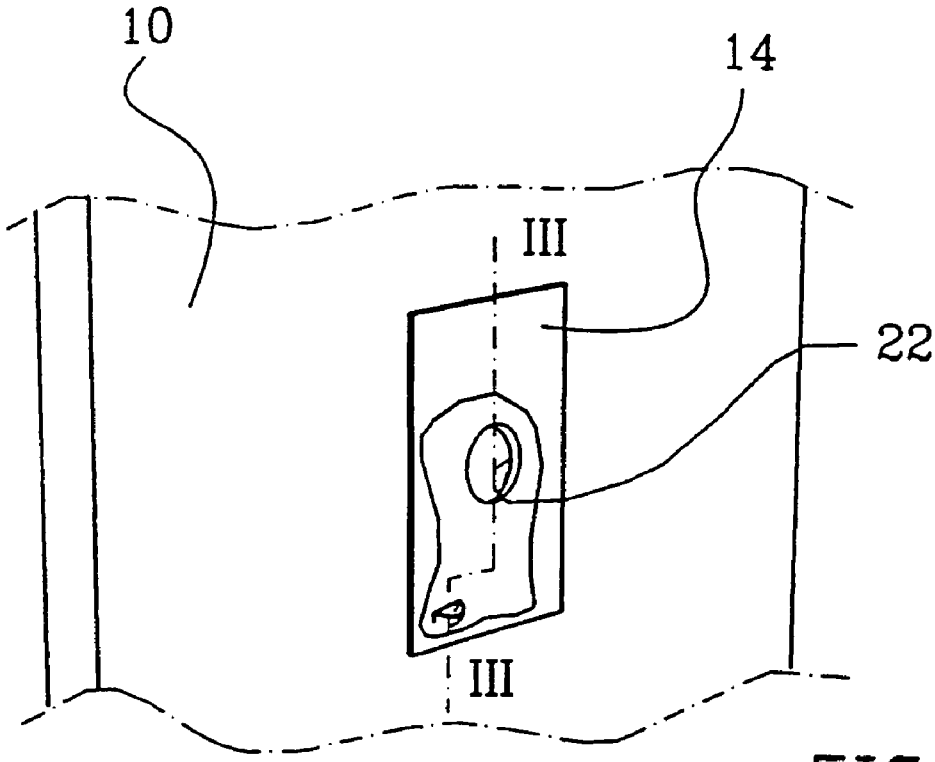
FIG. 1 shows a partial view of a wall, into which a reverse vending machine has been installed, represented here by the front cover.
Figure 2:
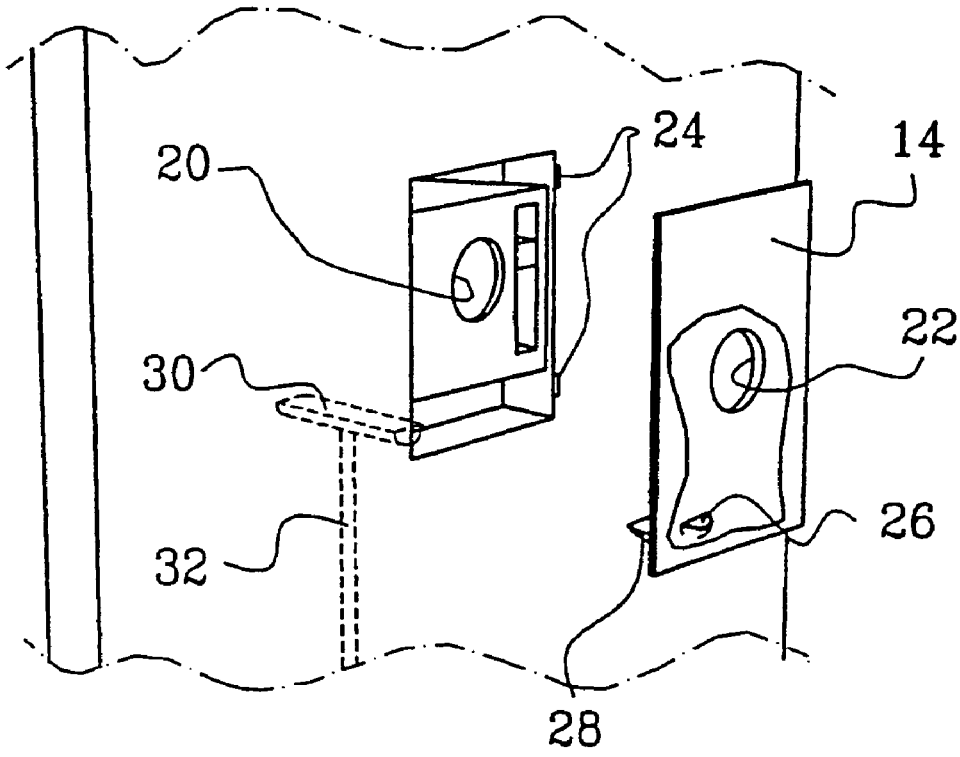
FIG. 2 shows a corresponding split view, in which the same front cover has been pulled straight out from the wall.
Figure 3:
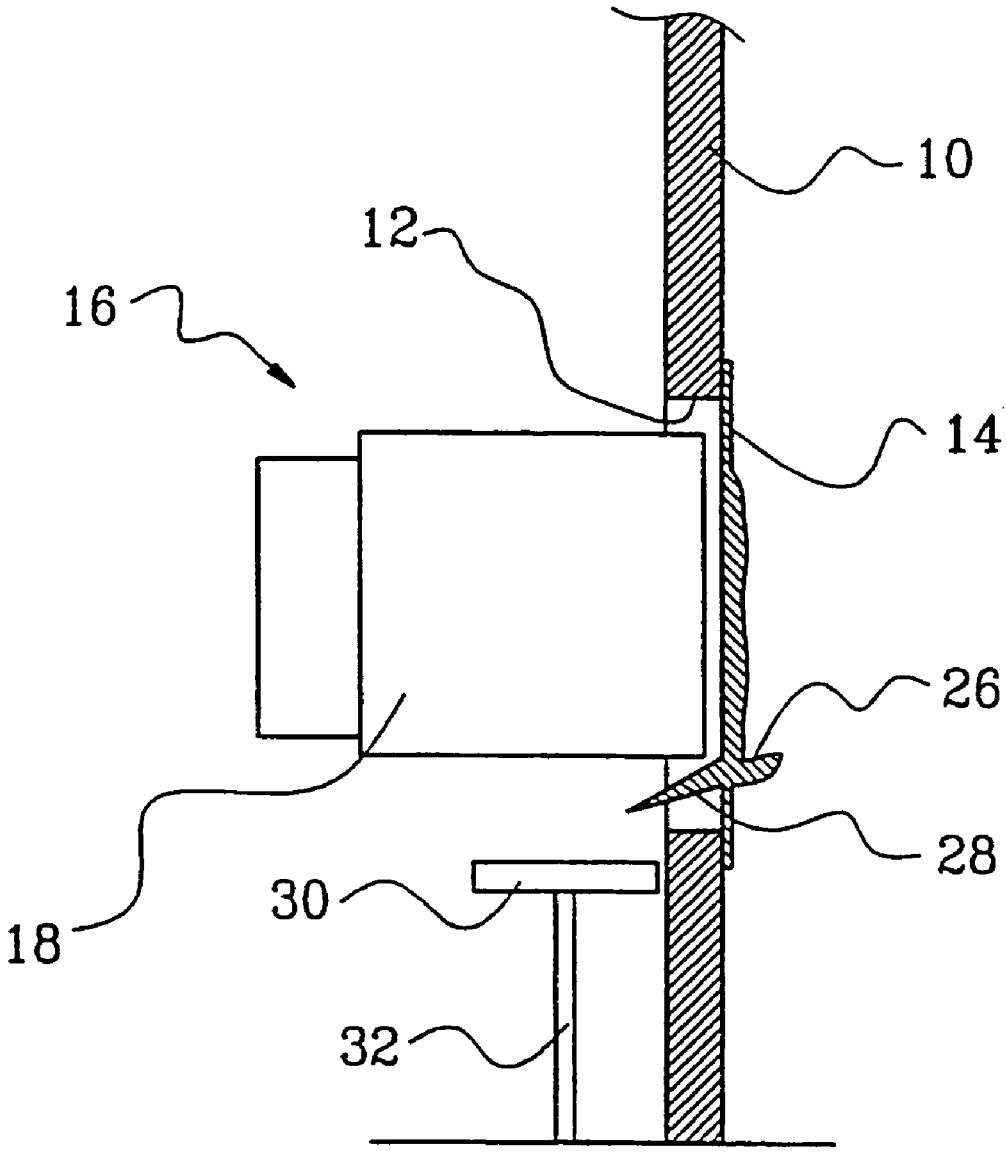
FIG. 3 is a vertical section III-III through the wall and the reverse vending machine on a somewhat larger scale.

In the drawings the reference numeral 10 identifies a wall that has a recess 12, e.g. rectangular, therethrough (FIG. 3) which is slightly smaller than a front cover 14 of plastic included in the reverse vending machine 16, of which the apparatus is known and is essentially contained in a housing 18, said housing having a front portion that extends partly into the recess 12 of the wall 10, and a hole 20 corresponding with the feed opening 22 for bottles and cans of the front cover 14.

The reverse vending machine's 16 bottle- and can-handling equipment and electronics for calculating the return are well known in connection with such reverse vending machines, and are not objects of the present invention, which essentially concerns the front cover 14.

Below the bottle/can feed opening 22 of the front cover 14, which is secured to the wall 10 or directly to the housing 18 by means of hinges 24, is provided, according to the invention, with a hole therethrough with an upward open bowl 26 underneath, merging at the rear surface of the front cover 14 into a drain pipe socket 28 at the back. The bowl 26 allows remnants of drinks from bottles and cans to be emptied in the immediate vicinity of the feed opening 22, thereby simplifying the operations, especially when many bottles and/or cans are involved; whereas earlier, with the use of a separate sink, a certain number of bottles first had to be subjected to one type of operation (emptying of remnants), then the same bottles had to be subjected to the main operation (insertion into the reverse vending machine).

Now, each bottle with a remnant can first be emptied and then immediately be inserted into the feed opening 22.

The feed opening 22 has no communication with the internal apparatus 16, 18 of the reverse vending machine. The same applies to the drain pipe socket 28, whose free end opening is open above a fixed, upward open transversal drain channel 30.

The drain channel 30 preferably extends horizontally underneath the internal apparatus 16,18 of the reverse vending machine, so that any type of liquid from bottles and cans, that might be running down in the area behind the front cover, could land in this drain channel 30, which is connected to a separate outlet 32. It is of advantage that the front cover 14 has no fixed connection to fixtures, pipes, cables etc., so that it can be opened and possibly lifted off its hinges 24 to uncover the internal mechanisms and apparatus of the reverse vending machine after a possible lock device has been unlocked.

The invention claimed is:

1. A reverse vending machine device for disposing of liquid remnants removed from containers before the containers are inserted a reverse vending machine, said device comprising: a front cover (14) for the reverse vending machine, said front cover having a front surface, a rear surface, and a container feed opening (22) extending through said front cover and accessible from outside the reverse vending machine, said container feed opening for receiving containers for insertion into the reverse vending machine through said container feed opening and an opening positioned within an internal container handling apparatus (18) of the reverse vending machine that corresponds to the container feed opening of said front cover, said front cover being formed to be secured to the reverse vending machine independently of internal container handling apparatus of the reverse vending machine and such that the reverse vending machine is operable with the cover removed, said container feed opening in said front cover being without a fixed connection to pipework within the reverse vending machine, said front cover having a drain opening (26) adjacent said container feed opening, said drain opening being formed as an upwardly open bowl passing through said front cover and extending from the front surface of said front cover for receiving liquid remnants from containers prior to insertion of the containers into the container feed opening, said bowl having a discharge opening (28) positioned behind the rear surface of the front cover for discharging liquid remnants received in the bowl in a downward direction; and a drain channel (30) separate and spaced from said bowl, said drain channel being aligned with said discharge opening of said bowl for receiving liquid remnants discharged from said discharge opening and draining same to an outlet (32).

2. A device according to claim 1, wherein the drain channel (30) has a generally horizontal extension positioned under said discharge opening of said bowl and is connected to an outlet (32).

3. A device according to claim 1 wherein said drain channel is upwardly open.

* * * * *